US005393297A

United States Patent [19]

Kristoff

[11] Patent Number: 5,393,297

[45] Date of Patent: Feb. 28, 1995

[54] NECK PILLOWS WITH INTERNAL VIBRATIONAL MECHANISMS

[76] Inventor: Beverly A. Kristoff, 164 Keelridge Dr., Georgetown, Ky. 40324

[21] Appl. No.: 209,239

[22] Filed: Mar. 14, 1994

[51] Int. Cl.[6] ..... A61H 1/00; A61H 7/00

[52] U.S. Cl. ..... 601/57; 601/69; 601/70; 601/98; 601/101; 601/102; 4/523

[58] Field of Search ..... 132/333; 4/519, 523; 604/46, 50, 51, 56-61-74, 98, 99, 101-103, 113, 115, 128, 84, 93, 94, 97

[56] References Cited

U.S. PATENT DOCUMENTS

| | | | |
|---|---|---|---|
| 2,648,332 | 8/1953 | Johnson | 601/56 X |
| 3,405,709 | 10/1908 | Mathers | 601/52 |
| 4,202,326 | 5/1980 | Van Gerpen | 601/103 X |
| 4,481,939 | 11/1984 | Mabuchi | 601/118 |
| 4,669,132 | 6/1987 | Courson | 4/523 |
| 4,763,364 | 8/1988 | Morgan | 4/523 |

FOREIGN PATENT DOCUMENTS

| | | | |
|---|---|---|---|
| 3306176 | 8/1984 | Germany | 601/97 |
| 1692578 | 11/1991 | U.S.S.R. | 601/98 |

*Primary Examiner*—Robert A. Hafer
*Assistant Examiner*—Brian E. Hanlon

[57] ABSTRACT

A neck pillow with internal vibrational mechanisms comprising a pillow positionable over a curved indentation at the edge of a shampooing sink, the pillow having a curved central extent to conform with the indentation of the sink and downwardly extending legs positionable interiorly and exteriorly of the sink, the pillow being of a waterproof external material configured to seal the interior of the pillow; and a plurality of vibrational balls secured together in a planar array beneath the foam, the balls being configured in a plurality of rows with the balls of each of the rows coupled by laterally extending wires with springs at the opposite ends thereof coupled to the lateral ends of the pillow, the central balls of the rows being hollow with a rotatable rod extending therethrough and with an eccentric within each central ball coupled for rotation with the rotation of the rod.

3 Claims, 4 Drawing Sheets

NECK PILLOWS WITH INTERNAL VIBRATIONAL MECHANISMS

BACKGROUND OF THE INVENTION

1. Field of the Invention

The present invention relates to neck pillows with internal vibrational mechanisms and more particularly pertains to vibrating neck rests and pillows at beauty salon shampooing sinks.

2. Description of the Prior Art

The use of neck rests and vibrators is known in the prior art. More specifically, neck rests and vibrators heretofore devised and utilized for the purpose of vibrating the necks of people and providing neck rest supports are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,763,364 to Morgan a shampoo bowl neck cushioning device.

U.S. Pat. No. 4,881,529 to Santos discloses a neck support collar.

U.S. Pat. No. 4,949,407 to Singer discloses a shampoo basin neck rest.

U.S. Pat. No. 4,998,303 to Smithers discloses a head support for salon basin.

U.S. Pat. No. 5,079,777 to Fowler discloses a top cover accessory to be worn about the neck during hair dressing.

In this respect, the neck pillows with internal vibrational mechanisms according to the present invention substantially departs from the conventional concepts and designs of the prior art, and in doing so provides an apparatus primarily developed for the purpose of vibrating neck rests and pillows at beauty salon shampooing sinks.

Therefore, it can be appreciated that there exists a continuing need for new and improved neck pillows with internal vibrational mechanisms which can be used for vibrating neck rests and pillows at beauty salon shampooing sinks. In this regard, the present invention substantially fulfills this need.

SUMMARY OF THE INVENTION

In view of the foregoing disadvantages inherent in the known types of neck rests and vibrators now present in the prior art, the present invention provides an improved neck pillows with internal vibrational mechanisms. As such, the general purpose of the present invention, which will be described subsequently in greater detail, is to provide a new and improved neck pillows with internal vibrational mechanisms and method which has all the advantages of the prior art and none of the disadvantages.

To attain this, the present invention essentially comprises a new and improved neck pillow with internal vibrational mechanisms comprising, in combination, a pillow positionable over a curved indentation at the edge of a shampooing sink, the pillow having a curved central extent to conform with the indentation of the sink and downwardly extending legs positionable interiorly and exteriorly of the sink, the pillow being of a waterproof external material configured to seal the interior of the pillow; a layer of elastomeric foam interior of the pillow in the upper extent thereof; a plurality of vibrational balls secured together in a planar array beneath the foam, the balls being configured in a plurality of rows with the balls of each of the rows coupled by laterally extending wires with springs at the opposite ends thereof coupled to the lateral ends of the pillow, the central balls of the rows being hollow with a rotatable rod extending therethrough and with an eccentric within each central ball coupled for rotation with the rotation of the rod; a motor for rotating the rod to rotate the eccentric and vibrate the central balls of the array to thereby move the laterally extending balls in response to the vibration of the central balls for thereby vibrating the neck of a patron resting her neck on the pillow; and a switch on the exterior surface of the pillow for activating and inactivating the motor.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved neck pillows with internal vibrational mechanisms which have all the advantages of the prior art neck rests and vibrators and none of the disadvantages.

It is another object of the present invention to provide new and improved neck pillows with internal vibrational mechanisms which may be easily and efficiently manufactured and marketed.

It is further object of the present invention to provide new and improved neck pillows with internal vibrational mechanisms which are of durable and reliable constructions.

An even further object of the present invention is to provide new and improved neck pillows with internal vibrational mechanisms which are susceptible of a low cost of manufacture with regard to both materials and labor, and which accordingly are then susceptible of low prices of sale to the consuming public, thereby making such neck pillows with internal vibrational mechanisms economically available to the buying public.

Still yet another object of the present invention is to provide new and improved neck pillows with internal vibrational mechanisms which provide in the apparatuses and methods of the prior art some of the advantages thereof, while simultaneously overcoming some of the disadvantages normally associated therewith.

Still another object of the present invention is to vibrate neck rests and pillows at beauty salon shampooing sinks.

Lastly, it is an object of the present invention to provide new and improved neck pillow with internal vibrational mechanisms comprising a pillow positionable over a curved indentation at the edge of a shampooing sink, the pillow having a curved central extent to conform with the indentation of the sink and downwardly extending legs positionable interiorly and exteriorly of the sink, the pillow being of a waterproof external material configured to seal the interior of the pillow; and a plurality of vibrational balls secured together in a planar array beneath the foam, the balls being configured in a plurality of rows with the balls of each of the rows coupled by laterally extending wires with springs at the opposite ends thereof coupled to the lateral ends of the pillow, the central balls of the rows being hollow with a rotatable rod extending therethrough and with an eccentric within each central ball coupled for rotation with the rotation of the rod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
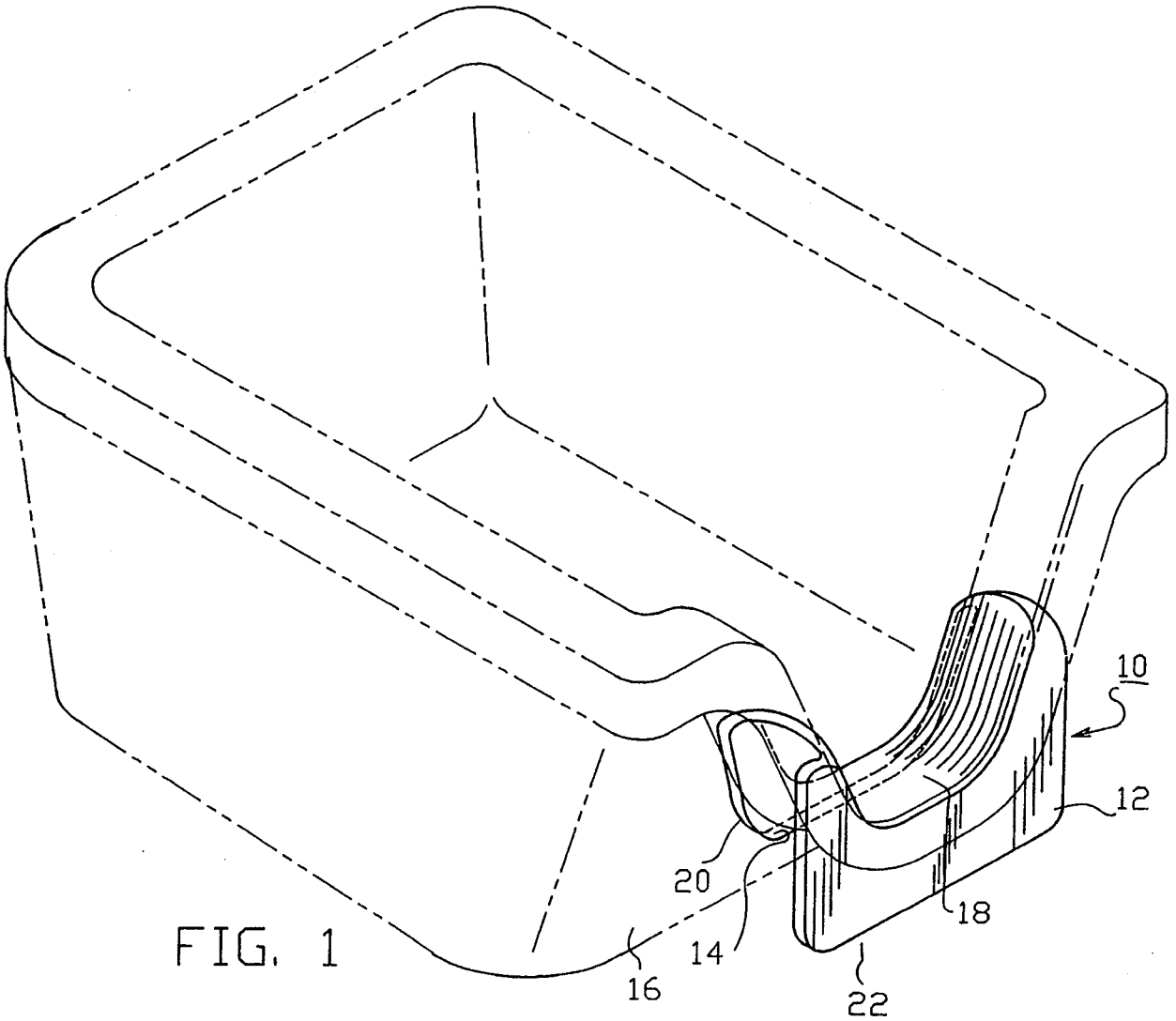
FIG. 1 is a perspective view of the preferred embodiment of the new and improved neck pillows with internal vibrational mechanisms constructed in accordance with the principles of the present invention.
Figure 2:
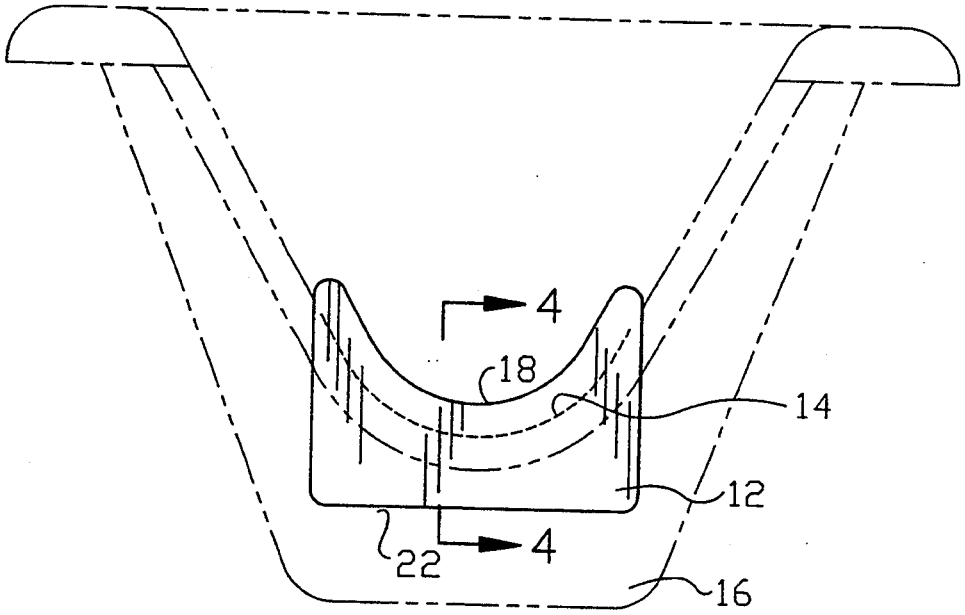
FIG. 2 is front elevational view of the pillow and sink shown in FIG. 1.
Figure 3:
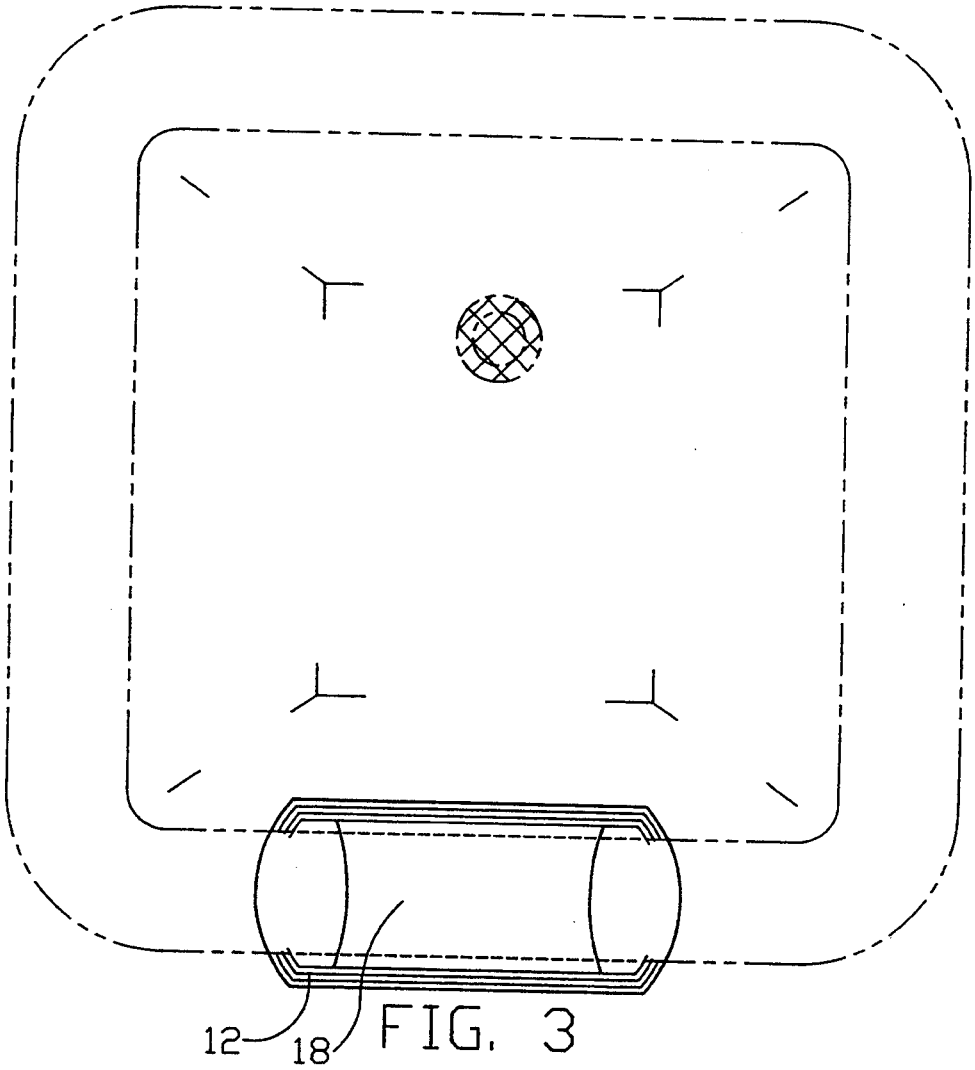
FIG. 3 is a plan view of the pillow and sink shown in FIGS. 1 and 2.
Figure 4:
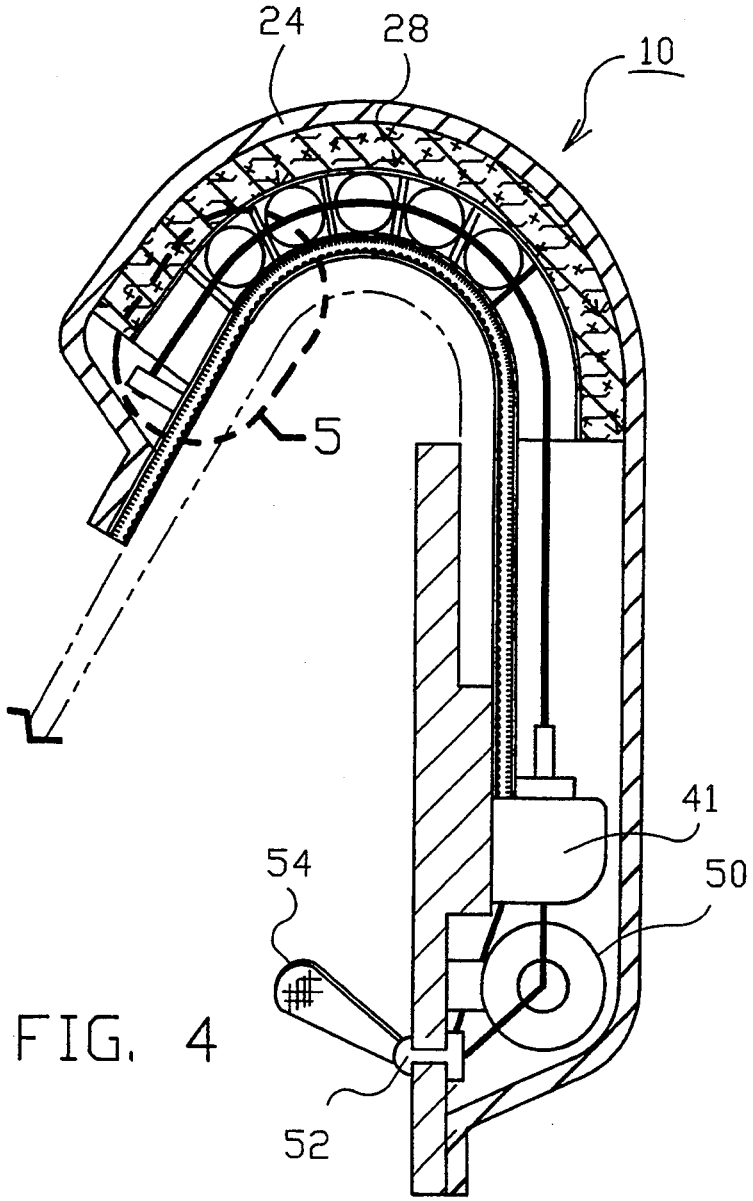
FIG. 4 is an enlarged sectional view of the pillow taken along line 4—4 of FIG. 2.
Figure 5:
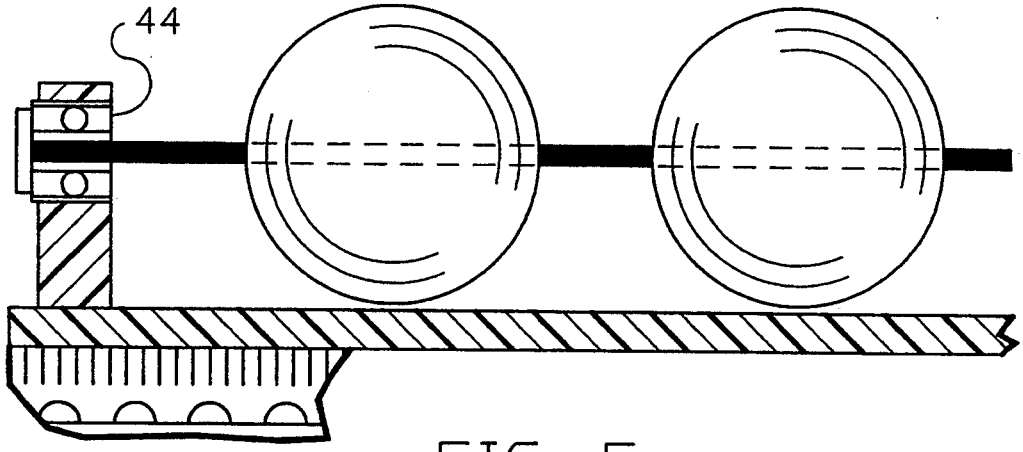
FIG. 5 is an enlarged showing of a portion of the balls taken along oval 5 of FIG. 4.
Figure 6:
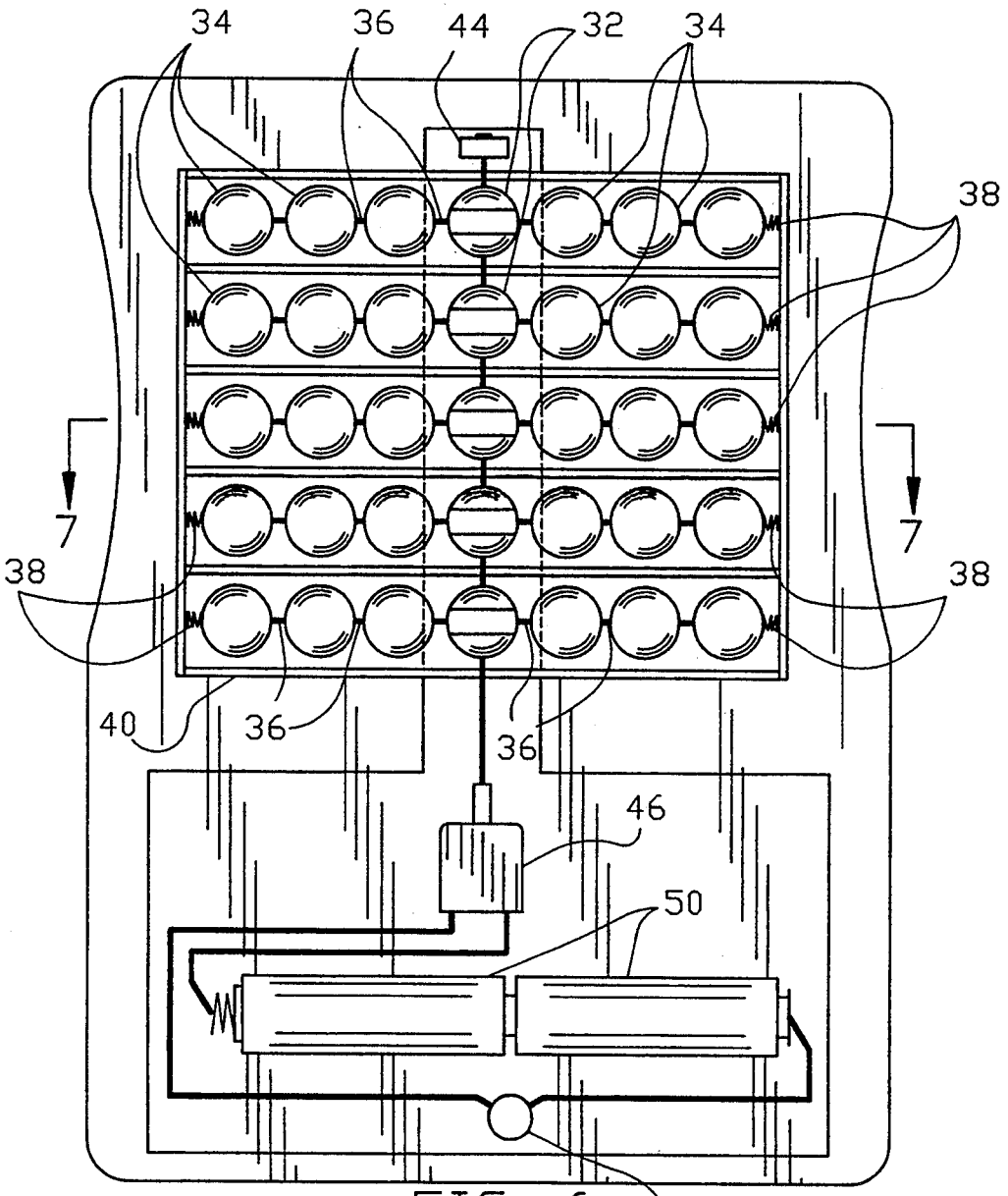
FIG. 6 is a plan view of the array of balls illustrated in FIG. 4.

With reference now to the drawings, and in particular to FIG. 1 thereof, the preferred embodiment of the new and improved neck pillows with internal vibrational mechanisms embodying the principles and concepts of the present invention and generally designated by the reference numeral 10 will be described.

The present invention, the new and improved neck pillows with internal vibrational mechanisms is comprised of a plurality of individual components. In their broadest context, such components include a pillow, a layer of elastomeric foam, a plurality of vibrational balls, a motor for vibrating the balls, and a switch for activating and inactivating the motor. The individual components are specifically configured and correlated one with respect to the other to attain the desired objective.

More specifically, the pillow 12 is adapted to be positioned over the curved indentation 14 of a shampoo sink 16 normally found in beauty salons. The pillow has a curved central extent 18. It also has depending legs 20 and 22. The legs are adapted to be draped over the interior and exterior of the sink adjacent to the indentation. The pillow is formed with a layer of waterproof material 24 configured to provide a seal to protect the interior components of the pillow.

Located interior of the pillow is a layer of elastomeric foam 28. Such foam is interior of the pillow of the upper extent thereof. It is adapted to conform to the shape of the neck of the person resting his or her neck thereon.

Located within the interior of the pillow, beneath the foam, are a plurality of vibrational balls 32 and 34. The balls are configured in rows with the balls of each row coupled through laterally extending wires 36. The balls include a central ball and laterally extending balls. Springs 38 are located at the opposite outboard ends of the wires for facilitating the vibration thereof. This springs are coupled at their outboard ends to a rigid frame 40 in a rectangular configuration to confine the rows and columns of the balls in a planar array adapted to curve and conform to the shape of the pillow and the indentation of the sink upon which it is located.

Figure 7:
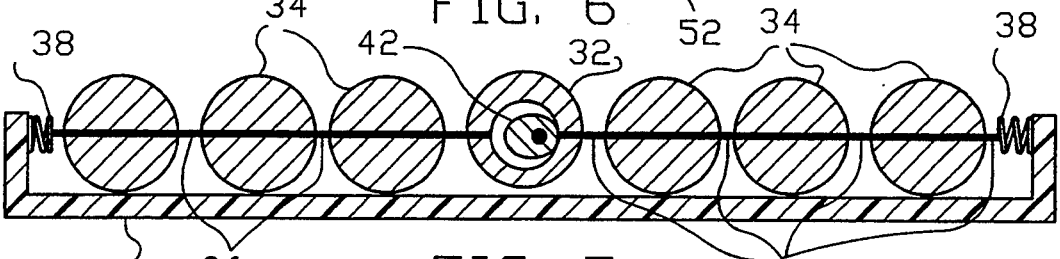
FIG. 7 is a sectional view taken along line 7—7 of FIG. 6.
Figure 8:
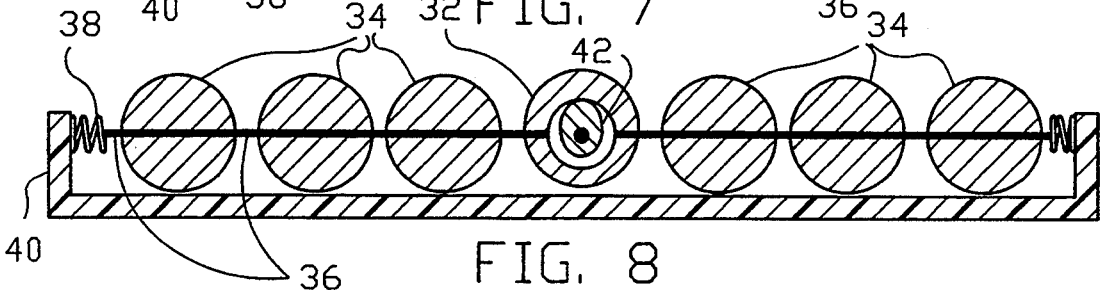
FIG. 8 is a cross sectional view similar to FIG. 7 but showing the eccentric in a rotated orientation.

The central ball of each row is hollow. Note FIGS. 7 and 8. Within the hollow interior of each central ball is a thin flexible rotatable rod. Secured to the rod for rotation therewith within each central ball is an eccentric 42. Rotation of the rod will therefor rotate the eccentric to thereby provide a rotational movement to the central ball of each row. One end of the rod is coupled to a ball bearing assembly 44 at its remote end. The near end of the rotatable rod is coupled to a motor 46.

The motor for effecting the vibration is located within the pillow at the near end. The motor is adapted to rotate about its axis to rotate the rod and its eccentric when activated. This will function to vibrate the central balls of the array. It will also then function to move the interior ends of the wire which are coupled to the central ball. Note FIGS. 7 and 8. Such movement of the central balls and laterally extending balls is in response to the vibration of the central balls. This thereby functions to vibrate the entire array of balls and the neck of the patron resting her head on the pillow. Operatively coupled to the motor are a pair of batteries 50 coupled through a switch 52. The switch is operable through a operator controlled mechanism 54 extending through the interior surface of the pillow. In this manner, the salon operator or the patron may throw the switch as desired to initiate or terminate the vibration of the balls and pillow.

The present invention is a device designed to be attached to hair salon sinks in order to massage and soothe the client's necks while they get their hair washed, color-treated, or permed. Having their hair done is a good opportunity for many people to relax anyway, the present invention adds immeasurably to that experience.

The present invention consists of a battery-operated vibration-type massager encased in a waterproof cover. The cover is shaped in such a way that it fits over the recessed neck opening of one of the salon's sinks. It can be fastened either by means of a weighted flap or perhaps hook and loop material Velcro straps. The device is activated by the weight of the customer's neck—it turns on when the client lays her head down on it and shuts off when she gets up.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved neck pillow with internal vibrational mechanisms comprising, in combination:

a pillow positionable over a curved indentation at the edge of a shampooing sink, the pillow having a curved central extent to conform with the indentation of the sink and downwardly extending legs positionable interiorly and exteriorly of the sink, the pillow being of a waterproof external material configured to seal an interior of the pillow;

a layer of elastomeric foam disposed in an interior of the pillow in the upper extent of said interior; a plurality of vibrational balls secured together in a planar array beneath the foam, the balls being configured in a plurality of rows with the balls of each row being coupled to springs by laterally extending wires, said springs coupled at a first end to said laterally extending wires and at a second end to the lateral ends of the pillow, the central ball of each row having a hollowed center, each of said hollowed centers containing an eccentric weight, said eccentric weights being coupled to a rotatable rod which extends through said hollowed centers for rotating said eccentric weights;

a motor for rotating the rod and the eccentric weight, thereby vibrating the central balls of the array and moving the laterally extending balls in response to the vibration of the central balls for vibrating the neck of a patron resting on the pillow; and a switch on the exterior surface of the pillow for activating and deactivating the motor.

2. A neck pillow with internal vibrational mechanisms comprising:

a pillow positionable over a curved indentation at the edge of a shampooing sink, the pillow having a curved central extent to conform with the indentation of the sink and downwardly extending legs positionable interiorly and exteriorly of the sink, the pillow being of a waterproof external material configured to seal an interior of the pillow; and a layer of foam disposed within an interior of the pillow;

a plurality of vibrational balls secured together in a planar array beneath the foam, the balls being configured in a plurality of rows with the balls of each row being coupled to springs by laterally extending wires, said springs coupled at a first end to said laterally extending wires and at a second end to the lateral ends of the pillow, the central ball of each row having a hollowed center, each of said hollowed centers containing an eccentric weight, said eccentric weights being coupled to a rotatable rod which extends through said hollowed centers for rotating said eccentric weights; and means for rotating said rod.

3. The device as set forth in claim 2 wherein said means for rotating said rod includes a motor for rotating the rod and the eccentric weight, thereby vibrating the central balls of the array to and moving the laterally extending balls in response to the vibration of the central balls for vibrating the neck of a patron resting on the pillow.

* * * * *